United States Patent [19]

Lavigne, Jr.

[11] 4,207,749

[45] Jun. 17, 1980

[54] THERMAL ECONOMIZED REFRIGERATION SYSTEM

[75] Inventor: William J. Lavigne, Jr., Fayetteville, N.Y.

[73] Assignee: Carrier Corporation, Syracuse, N.Y.

[21] Appl. No.: 944,426

[22] Filed: Sep. 21, 1978

Related U.S. Application Data

[63] Continuation of Ser. No. 828,449, Aug. 29, 1977, abandoned.

[51] Int. Cl.[2] ..... F25B 1/00; F25B 41/04; F25B 43/02

[52] U.S. Cl. ..... 62/115; 62/219; 62/471; 62/510

[58] Field of Search ..... 62/115, 117, 174, 219, 62/504, 505, 510, 512, 476, 498, 238 R

[56] References Cited

U.S. PATENT DOCUMENTS

| | | | |
|---|---|---|---|
| 2,277,647 | 3/1942 | Jones | 62/510 |
| 2,684,579 | 7/1954 | Hieatt et al. | 62/471 |
| 3,165,905 | 1/1965 | Ware | 62/219 |
| 3,226,940 | 1/1966 | Jekat et al. | 62/117 |
| 3,232,074 | 2/1966 | Weller et al. | 62/117 |
| 3,553,974 | 1/1971 | Osborne | 62/115 |
| 3,665,724 | 5/1972 | Anderson et al. | 62/196 |
| 4,014,182 | 3/1977 | Granryd | 62/117 |

*Primary Examiner*—Lloyd L. King

*Attorney, Agent, or Firm*—J. Raymond Curtin; Robert P. Hayter

[57] ABSTRACT

A refrigeration system which has a heat exchanger wherein refrigerant is evaporated to absorb heat from a fluid to be cooled, said heat exchanger receiving refrigerant from a vapor condensing economizer. The vapor condensing economizer receives liquid refrigerant from a condenser and has an orifice or a series of nozzles to maintain a pressure drop between the condenser and economizer so that a portion of the liquid refrigerant flashes to a vapor in the economizer to absorb heat from the remaining liquid refrigerant in the economizer. Condensing coils containing a cool heat exchange medium are positioned in the economizer to reduce the temperature and pressure in the economizer and to condense the refrigerant vapors back to a liquid for use in the refrigeration cycle.

9 Claims, 2 Drawing Figures

THERMAL ECONOMIZED REFRIGERATION SYSTEM

CROSS REFERENCES TO RELATED APPLICATIONS

This is a continuation of application Ser. No. 828,449 filed Aug. 29, 1977, now abandoned.

BACKGROUND OF THE INVENTION

1. Field of the Invention

The present invention relates to refrigeration systems. More particularly the present invention relates to refrigeration systems wherein a liquid refrigerant is subcooled in a vapor condensing economizer.

2. Description of the Prior Art

Refrigeration systems of the vapor compression type typically employ a compressor to increase the temperature and pressure of a gaseous refrigerant. Connected thereto is a condenser wherein gaseous refrigerant is cooled so that it changes state to a liquid refrigerant. Thereafter the refrigerant may be subcooled in a vapor compressing economizer wherein part of the refrigerant is vaporized absorbing heat from the remaining liquid refrigerant. In that type of economizer the vaporized refrigerant is drawn from the economizer into the compressor for recycling through the condenser. The economizer consists of a chamber or tank connected in the system to receive liquid refrigerant from the condenser and to pass liquid refrigerant to the evaporator. The chamber is also connected to the second or subsequent stage of a multi-stage compressor to extract vaporized or gaseous refrigerant from the chamber. The chamber is thus maintained at intermediate pressure level between the condenser and the evaporator. When the liquid refrigerant enters the chamber from the condenser the drop in pressure causes some of the refrigerant to flash to a vapor. The heat of vaporization required to flash the refrigerant is extracted from the remaining liquid refrigerant subcooling same. This subcooling of the liquid refrigerant produces an overall improvement in the efficiency of the system. The liquid refrigerant remaining in the economizer, which has now been subcooled passes on to the evaporator or chiller. In the chiller, the refrigerant is evaporated and drawn into the first stage of the compressor to complete the cycle. In the above described refrigeration system it is necessary that the compressor be a multistage compressor such that the flashed refrigerant from the economizer may be drawn into the compressor between the stages allowing the economizer to be at an intermediate pressure to the condenser and the chiller.

It is also known to use vapor compression economizers with a centrifugal compressor having a combination impeller blade such that the flashed gas from the economizer may enter the centrifugal compressor in the middle of the blade thereby creating within a single compressor two separate pressure levels. In addition vapor compression economizers have utilized a single stage compressor with appropriate valving arrangements to allow liquid refrigerant to flow from the condenser to the economizer wherein gaseous refrigerant is withdrawn by the compressor from the economizer until such time as the economizer temperature reaches the desired level. At such time a valve opens allowing the refrigerant to be drawn into the chiller and the valving allows the compressor to remove the flashed refrigerant gas from the chiller. The compressor runs continuously, however, the suction line to the compressor is cycled alternately between the economizer and the chiller such that the compressor is always withdrawing refrigerant from either the economizer or the chiller and such that the refrigerant passing from the economizer to the chiller is always at the desired temperature.

Prior refrigeration systems utilizing a vapor compressing economizer have required a multiple stage compressor to provide varying pressure levels for the flashing to occur. Refrigeration systems with one single stage compressor have previously not been adaptable for retrofit machinery to provide the flash economizing steps since the pressure differential required has not been obtainable. The refrigeration system described hereafter is adaptable to be retrofitted to a single stage centrifugal compressor without the addition of complicated valving or of a second compressor or a second compressor stage to recompress the flashed gas from the flash economizer.

SUMMARY OF THE INVENTION

An object of the present invention is to improve the efficiency of refrigeration systems.

A more specific object of the present invention is to provide a vapor condensing economizer for use in refrigeration systems.

Another object of the present invention is to provide a vapor compression refrigeration system wherein the refrigerant is flashed for subcooling and thereafter the refrigerant is recondensed within the economizer.

It is a further object of the present invention to provide a vapor condensing economizer which may be incorporated into a refrigeration system other than a vapor compression refrigeration system such as either an absorption refrigeration system or a steam jet refrigeration system.

Other objects will be apparent from the description to follow and from the appended claims.

The preceding objects are achieved by a refrigeration system wherein a vapor condensing economizer is located in the refrigerant circuit between the condenser and the chiller or evaporator. The temperature in the economizer is lowered below the temperature in the condenser by a heat exchanger condensing coil through which cool fluid passes. A restriction such as an orifice or a series of nozzles is placed in the refrigerant line between the condenser and the economizer so that a pressure differential which is produced by the temperature drop in the economizer is maintained between the condenser and the economizer. The thermal condensing economizer receives liquid refrigerant from the condenser and flashes that refrigerant such that part of the refrigerant changes state to a gas absorbing heat from the remaining liquid refrigerant and subcooling same. The subcooled liquid refrigerant than travels to an evaporator through an expansion device where it changes state from a liquid to a gas, absorbing heat from the fluid to be cooled. The gaseous refrigerant from the evaporator is recycled through the system. The flashed gas in the vapor condensing economizer is recondensed within the economizer by the condensing coil through which a supply of cooling fluid, at a sufficiently low temperature to recondense the flashed gas, is circulated. The recondensed liquid refrigerant is mixed with the subcooled refrigerant and conducted to the evaporator to aid in the overall efficiency of the system.

DESCRIPTION OF THE PREFERRED EMBODIMENT

Figures 1, 2:
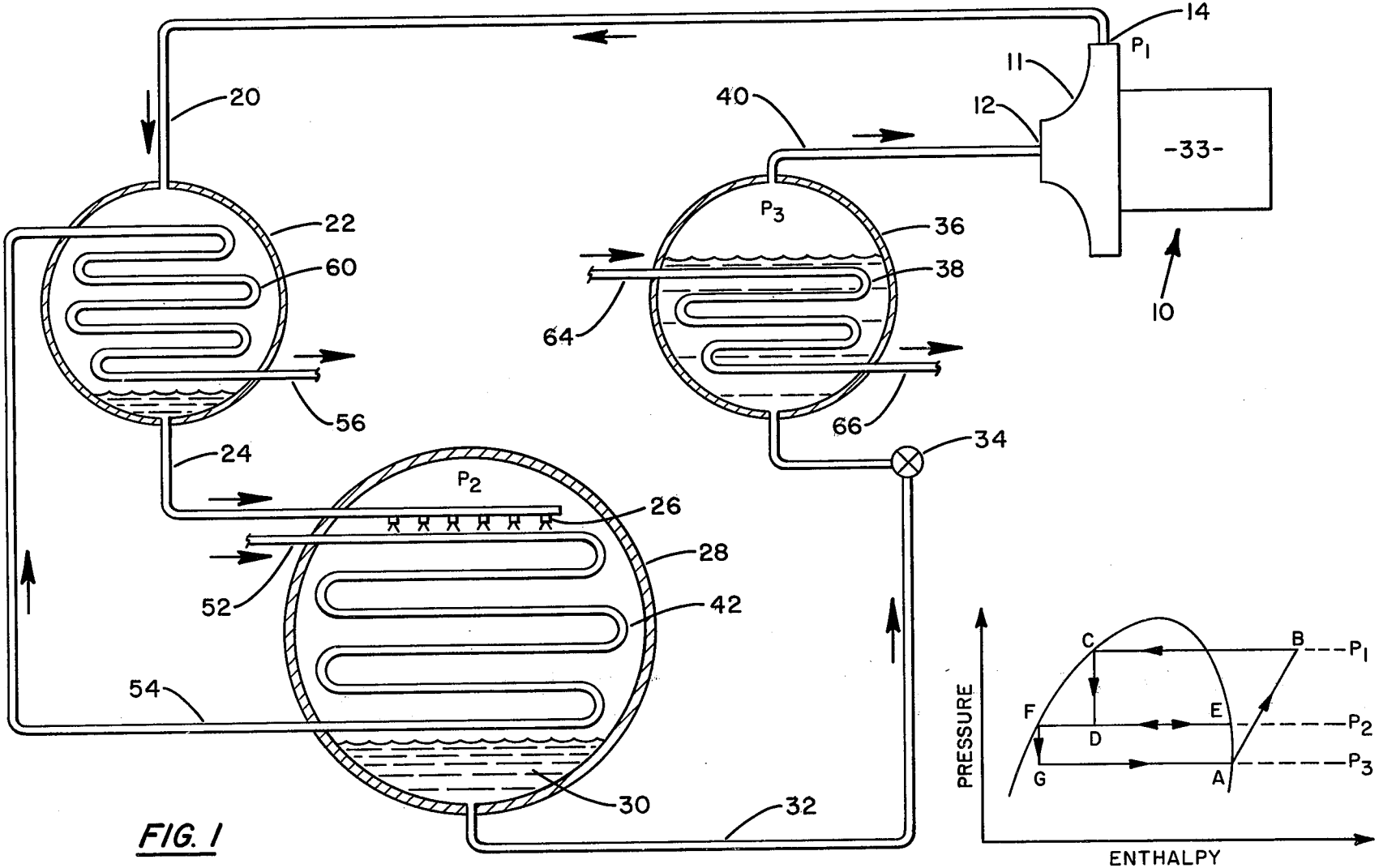
FIG. 1 is a schematic diagram of a vapor compression refrigeration system utilizing the vapor condensing economizer.
FIG. 2 is a pressure enthalpy graph showing a refrigeration cycle incorporating the present invention.

The embodiment of the invention described below is shown in use in a vapor compression refrigeration system having a single stage compressor, a condenser and an evaporator or chiller. It is, however, to be understood that the present invention finds applicability in any refrigeration system including absorption refrigeration systems, where liquid refrigerant is evaporated to produce a cooling effect.

Referring to FIG. 1, the schematic diagram of a vapor compression refrigeration system, there is shown a compressor 10 having compressor blades 11 located on the shaft of electric motor 33. Gaseous refrigerant is received through an inlet 12 and discharged refrigerant is increased as it is compressed, as gaseous refrigerant passing from outlet 14 through line 20 to condenser 22. Liquid refrigerant is collected from the bottom of condenser 22 and then transported through line 24 to a vapor condensing economizer 28. Some type of restriction such as a throttling valve, an orifice, or, as shown in FIG. 1, a series of nozzles 26 is incorporated into line 24 to maintain a pressure differential between condenser 22 and economizer 28. In the economizer 28 liquid refrigerant from the condenser is flashed through the series of nozzles 26 such that a part of the refrigerant changes state to a gas by absorbing heat from the remaining liquid refrigerant. Liquid refrigerant collects in reservoir 30 at the bottom of the economizer. The liquid refrigerant passes through line 32 to an expansion control device 34 wherein the pressure of the liquid refrigerant is reduced. The liquid refrigerant is then passed to chiller 36 wherein it changes state to a gas absorbing heat from the fluid within coil 38. Line 40 then conducts the gaseous refrigerant from the chiller to inlet 12 of compressor 10 wherein the gaseous refrigerant is recompressed.

Water or the other fluid to be cooled enters chiller 36 through line 64 and is circulated through coils 38. The cooled fluid in coil 38 exits through line 66 to a remote point, not shown, for subsequent use.

Within the thermal condensing economizer 28 there is mounted an economizer condenser coil 42. Condensing water or other cool fluid is circulated through the coil 42 to reduce the temperature and thus the pressure of economizer 28, and to condense the refrigerant flashed to a vapor in the economizer back to a liquid. The condensing water or other cool fluid is supplied through line 52 to economizer-condenser coil 42. The condensing water travels through the economizer-condenser coil 42 and then through conduit 54 to coil 60 of condenser 22. As shown herein the same condensing water then travels through coil 60 and is discharged through line 56. The condensing water picks up heat in the economizer-condenser coil and then picks up additional heat in condenser 22. The coils 42 and 60 are shown in series, however, they may be separate and distinct coils supplied with cool fluid from the same or separate sources.

Compressor 10 increases the pressure of the gaseous refrigerant to a pressure $P_1$. This is essentially the pressure in the condenser 22. Thereafter the pressure of the refrigerant is decreased upon entering the thermal condensing economizer to pressure $P_2$. The refrigerant flowing from the economizer to the chiller is reduced from pressure $P_2$ to pressure $P_3$ at the expansion control device 34. The refrigerant then travels from the chiller back to the compressor inlet at pressure $P_3$, and is increased in pressure from $P_3$ back to $P_1$ by the compressor. Thus, the pressure in the economizer is maintained at an intermediate pressure to the pressure in the condenser and the chiller.

FIG. 2 is a graph of pressure versus enthalpy for a typical refrigerant such as refrigerant R-11. Starting at point A of FIG. 2 it can be seen that the pressure and enthalpy of the refrigerant is increased from point A to point B, said distance representing the change in pressure and enthalpy due to compressor 10. Point B to point C represents the change in enthalpy in condenser 22 as the gaseous refrigerant changes state to a liquid refrigerant, with pressure remaining essentially constant. Thereafter the line from point C to point D represents the pressure decrease as the refrigerant is flashed into the economizer. From point D liquid refrigerant that was not flashed in the thermal condensing economizer is cooled to point F as a result heat being absorbed in the change of state of a portion of the refrigerant. The gaseous refrigerant that was flashed absorbed heat from the remaining liquid refrigerant and its enthalpy was increased as indicated by the line to point E. The economizer-condenser coil 42 then condenses the refrigerant from point E to point F such that the liquid refrigerant which was not flashed and the flashed refrigerant which has been recondensed to a liquid are both at point F. The distance from point F to point G represents the decrease is flashed by the expansion control device 34 into the chiller. The distance from G to A represents the change in enthalpy that occurs in the chiller as the liquid refrigerant changes state, and as heat is absorbed from the heat exchange coil 38.

In the diagram, FIG. 2, the left portion of the curve is the saturated liquid line and the right side of the curve is the saturated vapor line. The area between the two lines indicates a two phase mixture of liquid and vapor.

In order to obtain the most cooling work from a given amount of refrigerant it is desirable to cool the refrigerant to a position as close as possible to the left side of the curve so that when the refrigerant is flashed in the chiller as much heat as possible, indicated by the distance from G to A, is absorbed from the liquid to be cooled. Without the economizer, it is obvious that heat available to be absorbed by the refrigerant is proportional to that distance represented in the graph from point D to point E. By the provision of the economizer the refrigerant is cooled to point F. This increase in available heat absorption capacity produces an overall efficiency increase in the refrigeration system.

With a thermal condensing economizer refrigeration system, the economizer-condenser coil operates at a temperature lower than the main condenser. In a system as shown herein where condensing coils in the economizer and the condenser are arranged in series the cooling water is advantageously used by being circulated first through the economizer-condenser coil and then through the main condenser coil. Of course, additional condensing water may be supplied to the main condenser as needed to satisfy the load thereon.

The thermal condensing economizer 28 is shown within a single cylinder or shell in FIG. 1. The economizer-condenser coil 42 is shown as a heat exchange coil mounted in the shell in communication with the flashed refrigerant gas from nozzles 26. The physical arrangement is described merely to indicate that an economizer containing an economizer-condenser coil may be fitted within a portion of a conventional refrigeration machine utilizing cylindrical pressurized compartments. However the shape of the container and the location of the coil may be changed to suit the particular needs of the system.

The invention has been described in detail with particular reference to the preferred embodiment thereof but it will be understood that variations and modifications can be effected with the spirit and scope of the invention.

What is claimed is:

1. In a refrigeration system having a condenser which operates at a first pressure and temperature to condense refrigerant vapors to a liquid and an evaporator which operates at a second, lower pressure and temperature to evaporate liquid refrigerant to a vapor to produce cooling, a thermal condensing economizer comprising:

a container connected to receive liquid refrigerant from the condenser and to forward liquid refrigerant to the evaporator;

means to maintain a pressure differential between the condenser and the container; and means associated with said container to reduce the temperature of the container below the temperature of the condenser to allow refrigerant liquid to flash therein to a vapor to subcool the remaining liquid refrigerant before it circulates to the evaporator and to condense therein the refrigerant vapors so flashed for mixing with the liquid refrigerant being forwarded from the container to the evaporator.

2. The economizer of claim 1 wherein the means to reduce the temperature of the container and to condense refrigerant vapors comprises a heat exchange coil through which a cooling medium may be circulated.

3. The economizer of claim 1 wherein the means to maintain a pressure differential between the condenser and the container comprises nozzle means to spray liquid refrigerant into the container to improve the flashing of the liquid refrigerant to a vapor.

4. The economizer of claim 2 wherein the means to maintain a pressure differential between the condenser and the container comprises nozzle means positioned in the container to spray refrigerant from the condenser over the heat exchange coil in the container to bring the flashed refrigerant vapor into contact with the heat exchange coil to condense the vapor to a liquid.

5. An economizer for use in a refrigeration system having a condenser at a first pressure in which vaporized refrigerant is condensed to a liquid and an evaporator at a second pressure in which liquid refrigerant is vaporized comprising:

a container adapted to hold both vaporized and liquid refrigerant;

means to convey liquid refrigerant from the condenser to the container;

restriction means in the means to convey liquid refrigerant from the condenser to the container to maintain a pressure differential between the condenser and the container;

a heat exchange coil in the container adapted to receive a cooling medium to reduce the temperature and pressure of the container below the temperature and pressure of the condenser and to condense vaporized refrigerant in the container to a liquid; and means to convey liquid refrigerant from the container to the evaporator, and to maintain a pressure differential between the container and the evaporator.

6. A method of subcooling liquid refrigerant within a refrigeration system after the refrigerant has been condensed to a liquid in a condenser and before the liquid refrigerant enters the evaporator comprising the steps of:

transporting liquid refrigerant from the condenser into a container at a lower temperature and pressure than the condenser whereby a portion of the refrigerant is flashed to a vapor and the heat to vaporize the refrigerant is absorbed from the remaining liquid refrigerant to subcool the remaining liquid refrigerant;

condensing the vaporized refrigerant to a liquid within the container; and combining the condensed liquid refrigerant with the subcooled liquid refrigerant before the liquid refrigerant enters the evaporator.

7. The method of claim 6 for subcooling liquid refrigerant wherein the liquid refrigerant transported to the container is sprayed into the container to improve the flashing of liquid refrigerant to a vapor, and the condensing of vaporized refrigerant to a liquid is accomplished by bringing the vaporized refrigerant into heat exchange contact with a cooling medium.

8. A refrigeration system utilizing a refrigerant to cool a fluid which comprises:

a primary refrigerant loop having:

(a) a compressor for discharging refrigerant at an increased temperature and pressure;

(b) a condenser connected to receive the refrigerant from the compressor wherein the refrigerant is converted from a gas to a liquid;

(c) a thermal condensing economizer connected to the condenser wherein the liquid refrigerant is partially flashed to a gaseous refrigerant absorbing heat from the remaining liquid refrigerant;

(d) an expansion control device connected to receive liquid refrigerant from the thermal economizer wherein the refrigerant pressure is reduced;

(e) an evaporator that receives refrigerant from the expansion control device and discharges refrigerant to the compressor, at least part of said refrigerant changing state from a liquid to a gas to absorb heat from the fluid to be cooled; and a secondary refrigeration loop having:

(a) an economizer-condenser coil in communication with the flashed gas of the thermal condensing economizer wherein the flashed refrigerant gas is converted from a gaseous state to a liquid state; and (b) combining means for adding the refrigerant condensed by the economizer-condenser to the liquid refrigerant flowing to the evaporator of the primary refrigeration loop.

9. A flash gas refrigeration loop for use with a refrigeration system having a condenser and an evaporator through which refrigerant circulates which comprises:

a thermal condensing economizer connected to the condenser wherein the pressure of the liquid refrigerant received from the condenser is decreased so that part of the liquid refrigerant vaporizes absorbing heat from the remaining liquid refrigerant; and an economizer-condenser coil to cool the gaseous flashed refrigerant from a gaseous state to a liquid state so that the recondensed liquid refrigerant may together with the liquid refrigerant from the condenser that was not vaporized be conducted to the evaporator.

* * * * *